US009878441B1

(12) United States Patent
Kao

(10) Patent No.: US 9,878,441 B1
(45) **Date of Patent: *Jan. 30, 2018**

(54) SOCKET HOLDING FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/345,575

(22) Filed: Nov. 8, 2016

(30) Foreign Application Priority Data

Oct. 20, 2016 (TW) ..... 105133949 A

(51) Int. Cl.
*B25H 3/00* (2006.01)
*B25H 3/04* (2006.01)
*B25H 3/06* (2006.01)

(52) U.S. Cl.
CPC ..... *B25H 3/003* (2013.01); *B25H 3/04* (2013.01); *B25H 3/06* (2013.01)

(58) Field of Classification Search
CPC . B25H 3/003; B25H 3/04; B25H 3/06; B25H 3/00
See application file for complete search history.

(56) References Cited

U.S. PATENT DOCUMENTS 5,715,951 A * 2/1998 Dembicks ..... B25H 3/06 206/378
6,386,363 B1 * 5/2002 Huang ..... B25H 3/003 206/1.5
8,727,142 B2 * 5/2014 Shapiro ..... A47B 97/00 206/553
8,955,698 B2 * 2/2015 Hsieh ..... B25H 3/04 206/378
9,186,790 B1 * 11/2015 Kao ..... B25H 3/06
9,452,524 B1 * 9/2016 Kao ..... B25H 3/04
9,522,467 B1 * 12/2016 Kao ..... A47F 7/0028
9,538,862 B2 * 1/2017 Kao ..... A47F 5/08
9,539,721 B1 * 1/2017 Kao ..... B25H 3/04
9,656,385 B1 * 5/2017 Kao ..... B25H 3/04
9,662,781 B1 * 5/2017 Kao ..... B25H 3/003
9,694,491 B1 * 7/2017 Kao ..... B25H 3/04
2005/0221664 A1 * 10/2005 Winnard ..... B25H 3/003 439/510
2011/0089798 A1 * 4/2011 Shapiro ..... A47B 97/00 312/348.3
2015/0336262 A1 * 11/2015 Kao ..... B25H 3/06 206/378
2016/0096264 A1 * 4/2016 Kao ..... B25H 3/06 206/378

* cited by examiner

*Primary Examiner* — Leslie A Nicholson, III
*Assistant Examiner* — Kimberley S Wright
(74) *Attorney, Agent, or Firm* — Bacon & Thomas, PLLC

(57) ABSTRACT

A socket holding frame has a track base, a positioning board, and at least one positioning mount. The track base has a bottom panel and two rails. Each rail has a sliding channel. The positioning board is disposed on the track base and has two multiple first engaging segments. The multiple first engaging segments are formed on the top surface of the positioning board at spaced intervals, and are aligned in a straight line. Each first engaging segment has a curved engaging groove and an engaging protrusion formed in the curved engaging groove. The at least one positioning mount is slidably and rotatably mounted on the track base. Each positioning mount has multiple second engaging segments, and part of the multiple second engaging segments are selectively engaged with one of the multiple first engaging segments.

9 Claims, 9 Drawing Sheets

SOCKET HOLDING FRAME

BACKGROUND OF THE INVENTION

1. Field of the Invention

The present invention relates to a socket holding frame, and more particularly to a socket holding frame that may provide a positioning effect in rotation and movement to sockets that are mounted on the socket holding frame.

2. Description of Related Art

A conventional socket holding frame has a track base and multiple positioning mounts slidably mounted on the track base. The positioning mounts are used to hold sockets on the track base to allow a user to look for the marks of sizes or model numbers on outer peripheries of the sockets by rotating the sockets. To move or rotate the sockets easily and quickly, the track base is not set up with any fixing structure for fixing the positioning mounts with the track base. Hence, the positioning mounts may be moved or rotated by impact or hit by an unexpected force, such that the user has to frequently and repeatedly look for the marks of sizes or model numbers of the sockets, which is very inconvenient in use.

With reference to FIG. 7, FIG. 7 shows a conventional socket holding frame, wherein the positioning mounts can be positioned relative to the track base in movement. With reference to FIG. 8, FIG. 8 shows a conventional socket holding frame, wherein the positioning mounts can be positioned relative to the track base in rotation. However, the conventional socket holding frames shown in FIGS. 7 and 8 can only position the positioning mounts relative to the track base either in movement or in rotation but cannot position the positioning mounts relative to the track base both in movement and in rotation at the same time.

To overcome the shortcomings of the conventional socket holding frame, the present invention provides a socket holding frame to mitigate or obviate the aforementioned problems.

SUMMARY OF THE INVENTION

The present invention relates to a socket holding frame, and more particularly to a socket holding frame that can provide a positioning effect in movement and rotation to sockets that are mounted on the socket holding frame.

The socket holding frame has a track base, a positioning board, and at least one positioning mount. The track base has a bottom panel and two rails. The bottom panel is elongated and has a top surface. The two rails are disposed respectively on two sides of the top surface of the bottom panel, each one of the two rails has a sliding channel having an opening, and the two openings of the two sliding channels of the two rails face each other. The positioning board is disposed on the track base and has two long opposite sides, a middle, a top surface, and multiple first engaging segments. The multiple first engaging segments are formed on the top surface of the positioning board at spaced intervals, and are aligned in a straight line. Each first engaging segment has a curved engaging groove and an engaging protrusion formed in the curved engaging groove. The at least one positioning mount is slidably and rotatably mounted on the track base. Each one of the at least one positioning mount has a sliding seat and an extending element. The sliding seat is slidably and rotatably mounted in the sliding channels of the rails and is engaged selectively with one of the multiple first engaging segments on the positioning board. The sliding seat has a bottom side, a top side, and an engaging flange formed on and protruding downwardly from the bottom side of the sliding seat. The engaging flange has a bottom surface and multiple second engaging segments. The second engaging segments are formed on the bottom surface of the engaging flange at spaced intervals and are arranged annularly. Part of the multiple second engaging segments are selectively engaged with one of the multiple first engaging segments. The extending element is formed on and protrudes upwardly from the top side of the sliding seat.

Other objects, advantages, and novel features of the invention will become more apparent from the following detailed description when taken in conjunction with the accompanying drawings.

DETAILED DESCRIPTION OF PREFERRED EMBODIMENT

Figure 1:
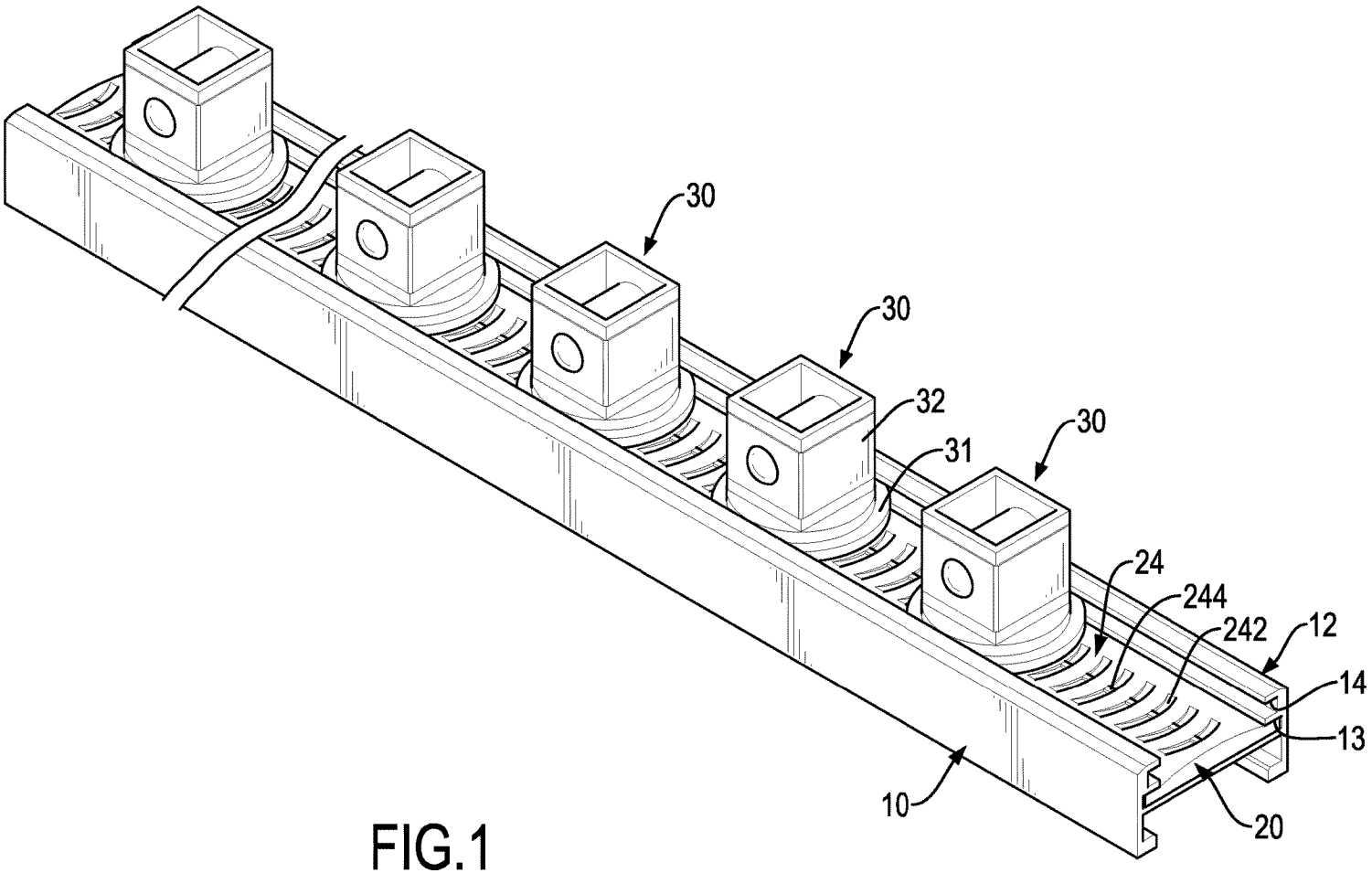
FIG. 1 is a perspective view of a socket holding frame in accordance with the present invention.
Figure 2A:
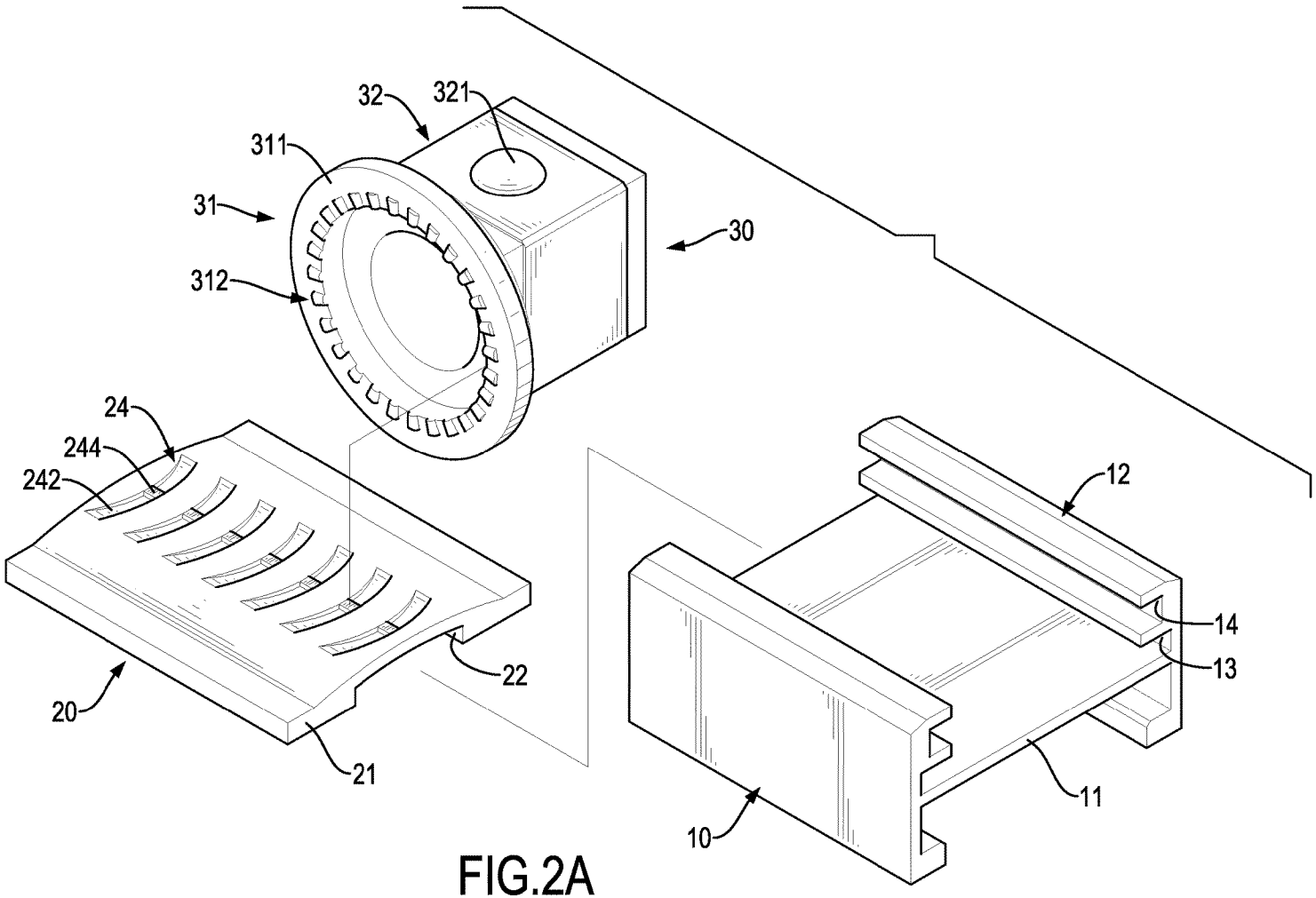
FIG. 2A is an enlarged exploded perspective view of the socket holding frame in FIG. 1.
Figure 2B:
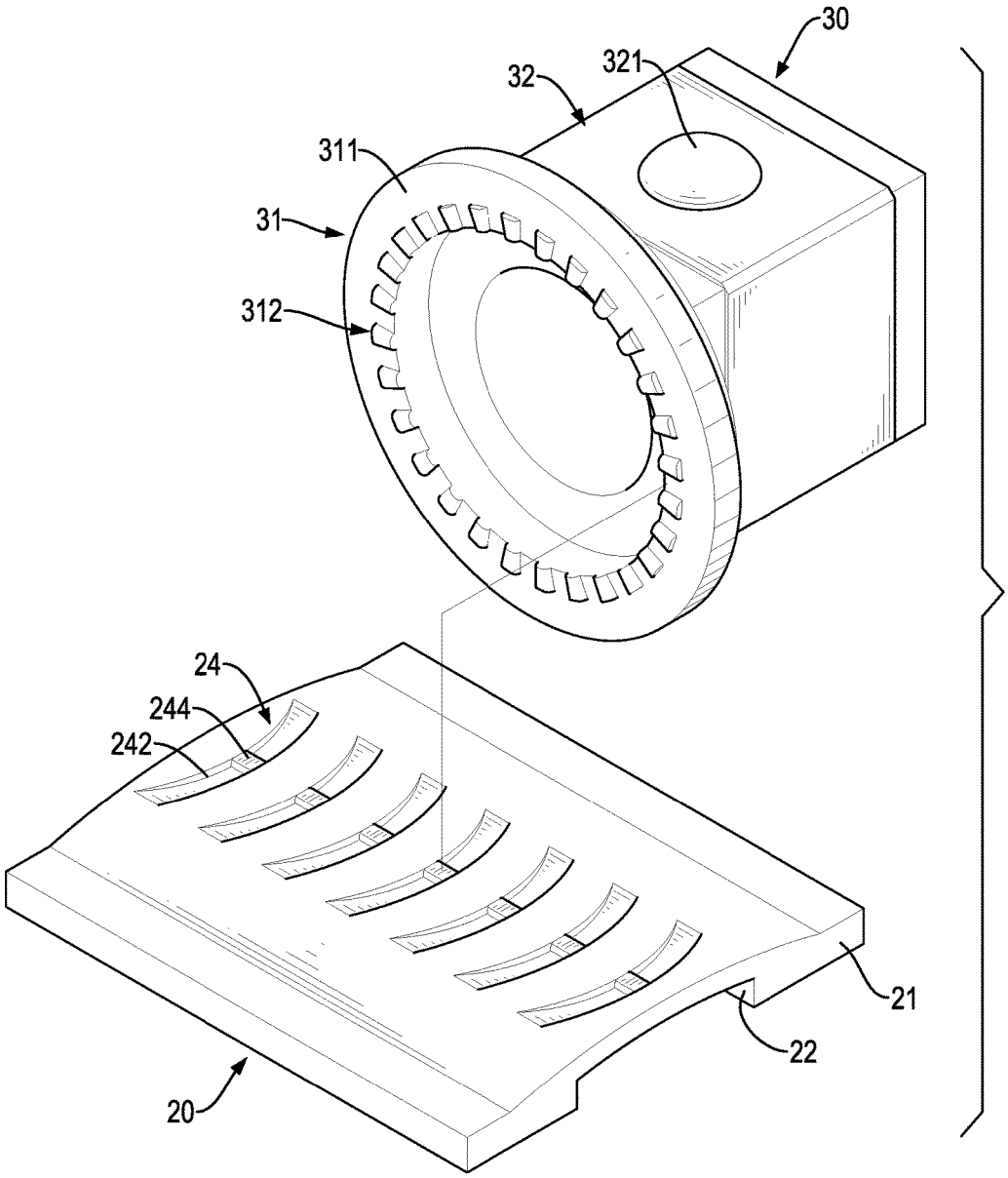
FIG. 2B is another enlarged exploded perspective view of the socket holding frame in FIG. 1.
Figures 3A, 3B:
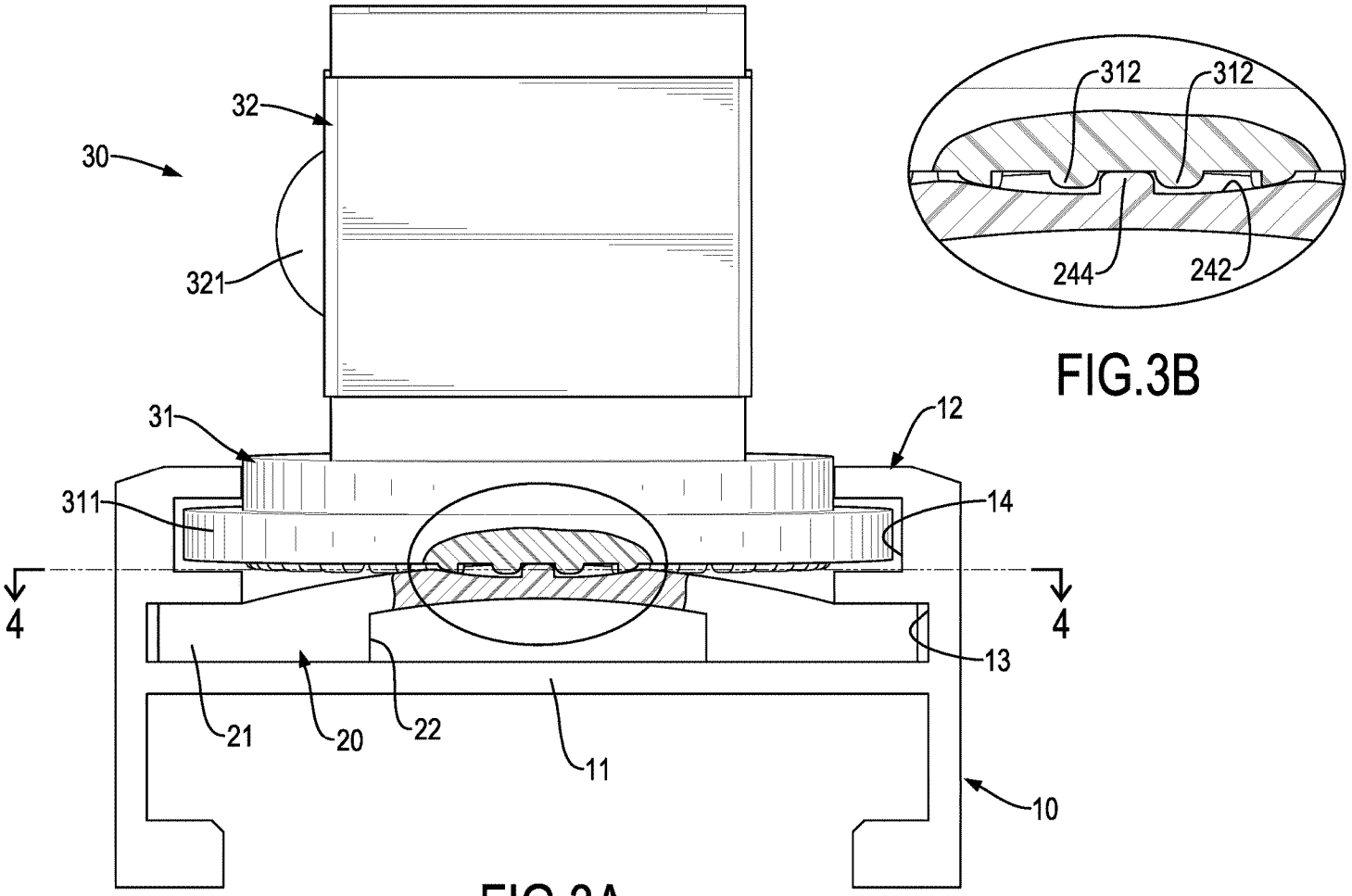
FIG. 3A is an enlarged end view in partial section of the socket holding frame in FIG. 1.
FIG. 3B is an enlarged end view in partial section of the socket holding frame in FIG. 3A.

With reference to FIGS. 1 to 3, a socket holding frame in accordance with the present invention comprises a track base 10, a positioning board 20, and at least one positioning mount 30.

The track base 10 is elongated, is made of metal, and is preferably an aluminum extrusion. The track base comprises a bottom panel 11 and two rails 12. The bottom panel 11 is elongated and has a top surface. The two rails 12 are respectively formed on and protrude from two sides of the top surface of the bottom panel 11. Each rail 12 has a sliding channel 14 and a positioning channel 13. Each one of the sliding channels 14 and the positioning channels 13 has an opening. The openings of the sliding channels 14 face each other and the openings of the positioning channels 13 also face each other. The positioning channel 13 of each rail 12 is located below the sliding channel 14 of the rail 12.

The positioning board 20 is resilient, is mounted in the positioning channels 13 in the rails 12 of the track base 10, and has two long opposite sides, two free ends, a middle, a top surface, a bottom surface, two rail bars 21, a recess 22, and multiple first engaging segments 24. The positioning board 20 is bent upwardly from the long opposite sides to the middle of the positioning board 20. The two rail bars 21 are formed on and protrude outwardly from the bottom surface of the positioning board 20 respectively at the two long opposite sides of the positioning board 20 and are mounted respectively in the positioning channels 13 of the rails 12. The recess 22 is formed in the bottom surface of the positioning board 20 at the middle of the positioning board 20 between the free ends of the positioning board 20, and is parallel with the long opposite sides of the positioning board 20 to define a space between the middle of the positioning board 20 and the top surface of the bottom panel 11. The space allows the positioning board 20 to be deformed relative to the track base 10. Alternatively, the positioning board 20 may be formed with the track base 10 as a single piece.

The multiple first engaging segments 24 are formed on the top surface of the positioning board 20 at spaced intervals between the two free ends of the positioning board 20. The first engaging segments 24 are aligned in a straight line and are formed at the middle of the top surface of the positioning board 20 at spaced intervals. Each one of the multiple engaging segments 24 has a curved engaging groove 242 and an engaging protrusion 244. Preferably, the curved engaging groove 242 has a depth gradually increasing from two ends to the middle of the curved engaging groove 242. The engaging protrusion 244 is formed in the curved engaging groove 242. Preferably, the engaging protrusion 244 is formed on a middle of the curved engaging groove 242, and the engaging protrusions 244 of the first engaging segments are aligned with each other.

The at least one positioning mount 30 is slidably and rotatably mounted on the track base 10, and each one of the at least one positioning mount 30 has a sliding seat 31 and an extending element 32. The sliding seat 31 is round and resilient, is slidably and rotatably mounted in the sliding channels 14 in the rails 12, and is selectively engaged with one of the multiple first engaging segments 24 of the positioning board 20. The sliding seat 31 has a bottom side, a top side, and an engaging flange 311. The engaging flange 311 is formed on and protrudes downwardly from the bottom side of the sliding seat 31 and has a bottom surface and multiple second engaging segments 312. The multiple second engaging segments 312 are continuously formed in the bottom surface of the engaging flange 311 at spaced intervals, and are arranged annularly. Part of the multiple second engaging segments 314 are engaged with the curved engaging groove 242 of one of the multiple first engaging segments 24, and adjacent two of said part of the multiple second engaging segments 314 engage with the engaging protrusion 244 of the first engaging segment 24.

The extending element 32 is formed on and protrudes upwardly from the top side of the sliding seat 31. Furthermore, the extending element 32 of each one of the at least one positioning mount 30 is an insertion button. The extending element 32 is hollow, is rectangular, and has a side surface and a protruding ball 321. The protruding ball 321 is mounted in and extends outwardly from the side surface of the insertion button.

Figure 4:
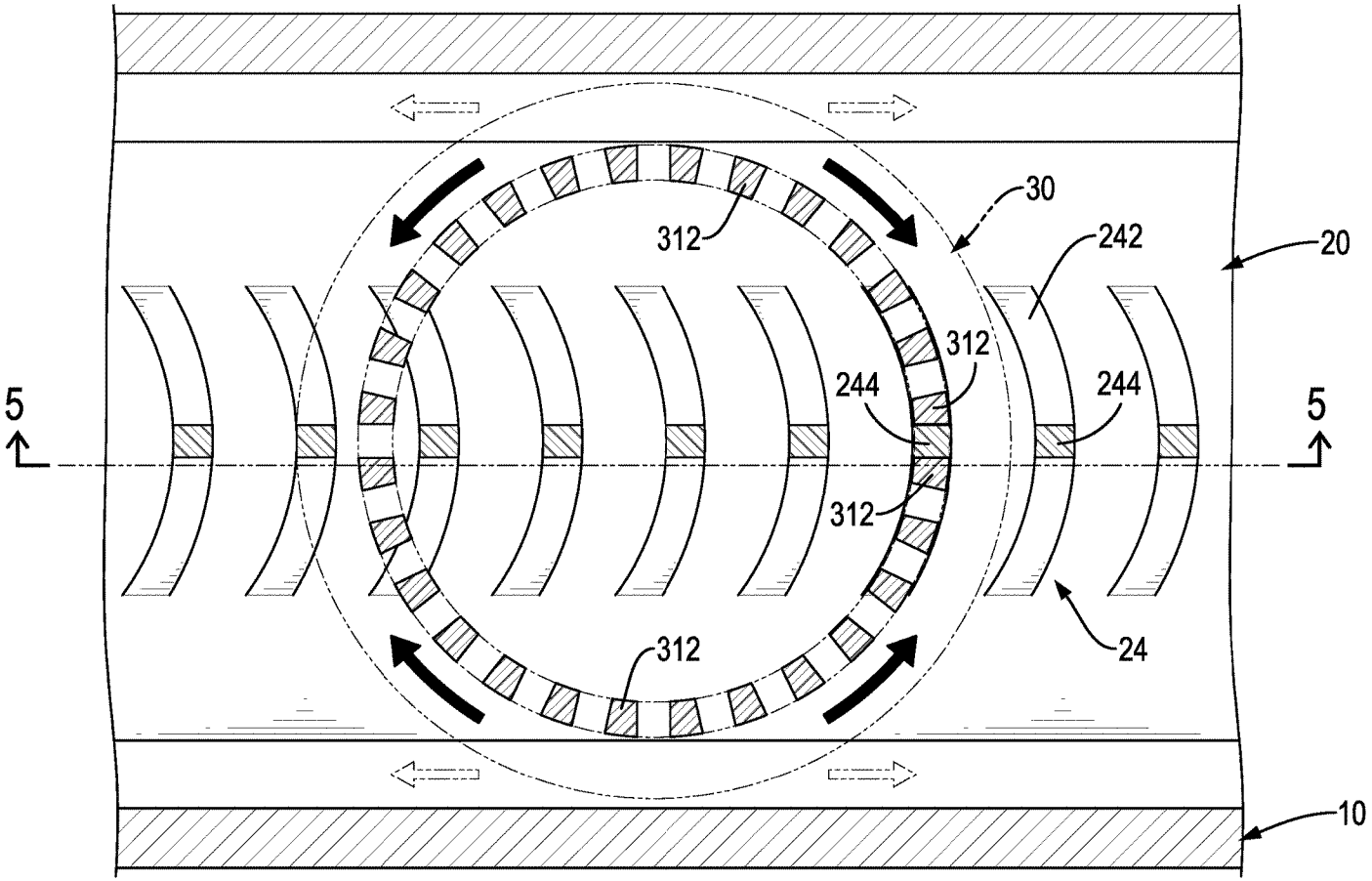
FIG. 4 is an enlarged operational top view in partial section of the socket holding frame along the line 4-4 in FIG. 3A.
Figures 5A, 5B, 5C:
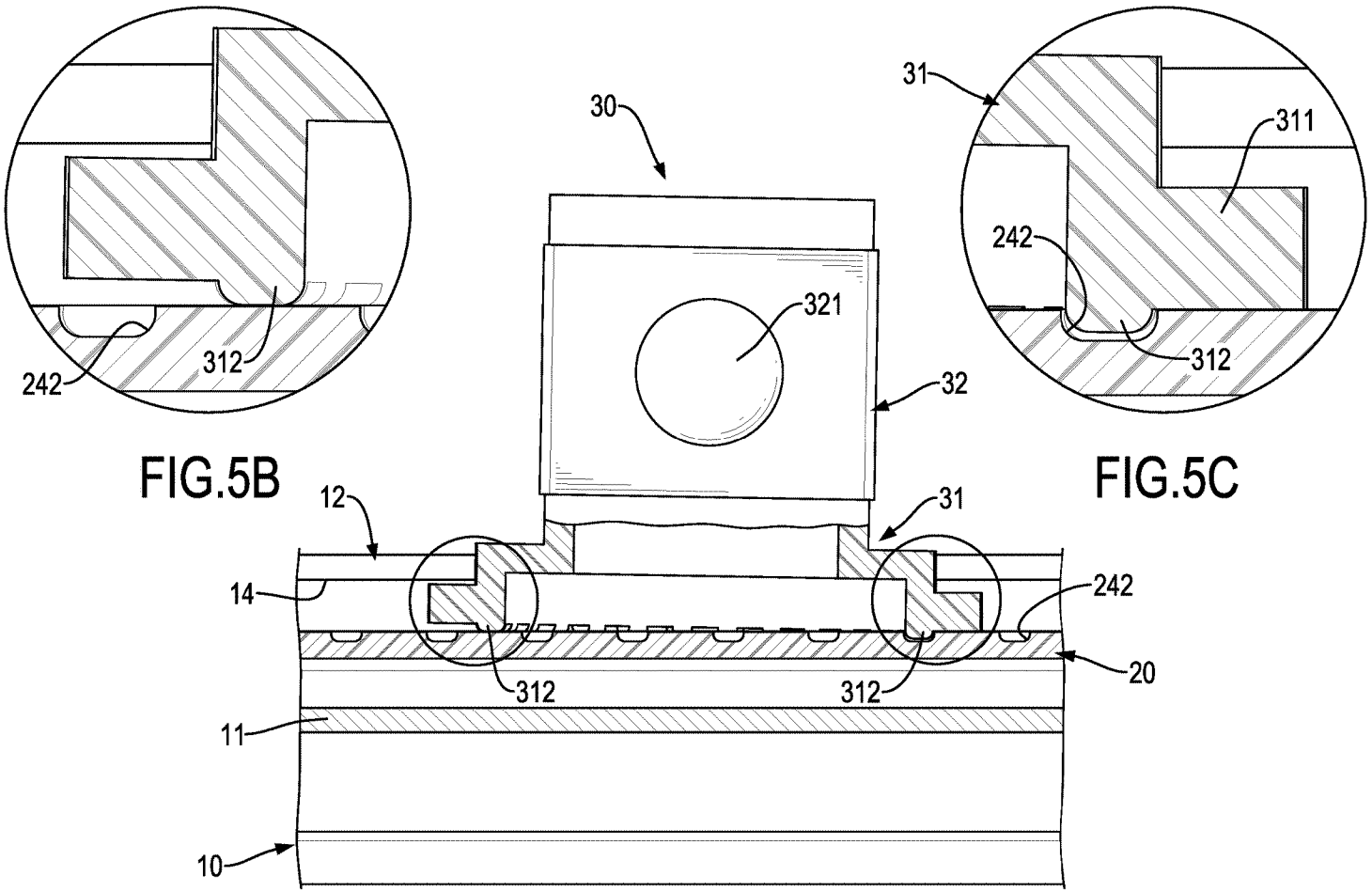
FIG. 5A is an enlarged end side view in partial section of the socket holding frame along the line 5-5 in FIG. 4.
FIG. 5B is an enlarged end cross sectional side view of the socket holding frame in FIG. 5A.
FIG. 5C is another enlarged end cross sectional side view of the socket holding frame in FIG. 5A.

With reference to FIGS. 3 to 5, to dispose the positioning mount 30 onto the track base 10, the engaging flange 311 of the positioning mount 30 is inserted into the sliding channels 14 in the rails 12 from one of the ends of the track base 10. Consequently, the positioning mount 30 can be slid along the positioning board 20 to a desired position to engage part of the second engaging segments 312 with the curved engaging groove 242 of a corresponding one of the first engaging segments 24. With the engagement between the parts of the second engaging segments 312 and the corresponding curved engaging groove 242, the positioning mount 30 can be positioned at the desired position. At this time, adjacent two of said parts of the second engaging segments 312 are engaged with the engaging protrusion 244 in the corresponding engaging groove 242. With the engagement of the adjacent two second engaging segments 312 and the engaging protrusion 244, the angular position of the positioning mount 30 can be fixed.

Figure 6:
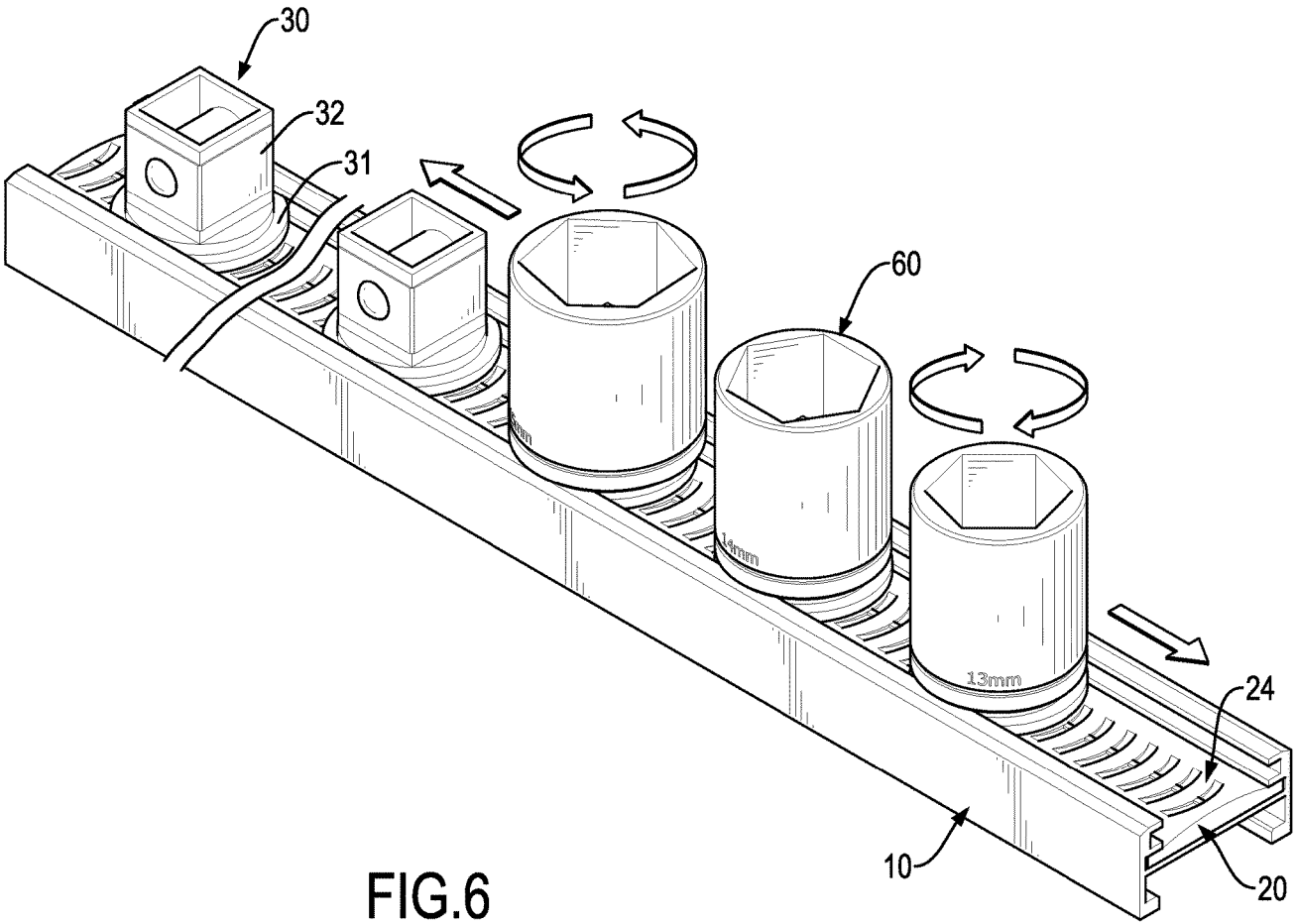
FIG. 6 is an operational perspective view of the socket holding frame in FIG. 1.
Figure 7:
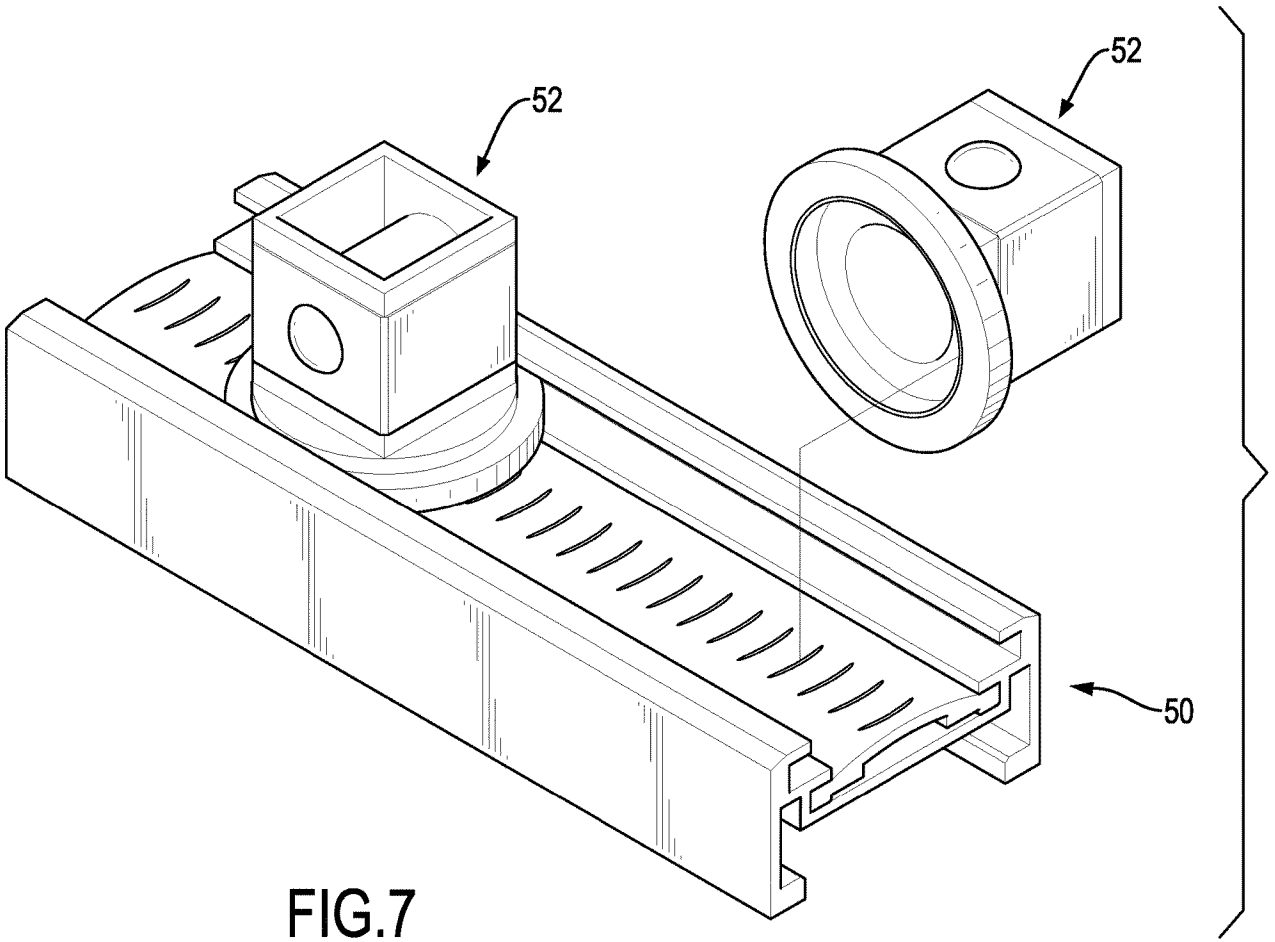
FIG.7 PRIOR ART
FIG. 7 is an exploded perspective view of a conventional socket holding frame.
Figure 8:
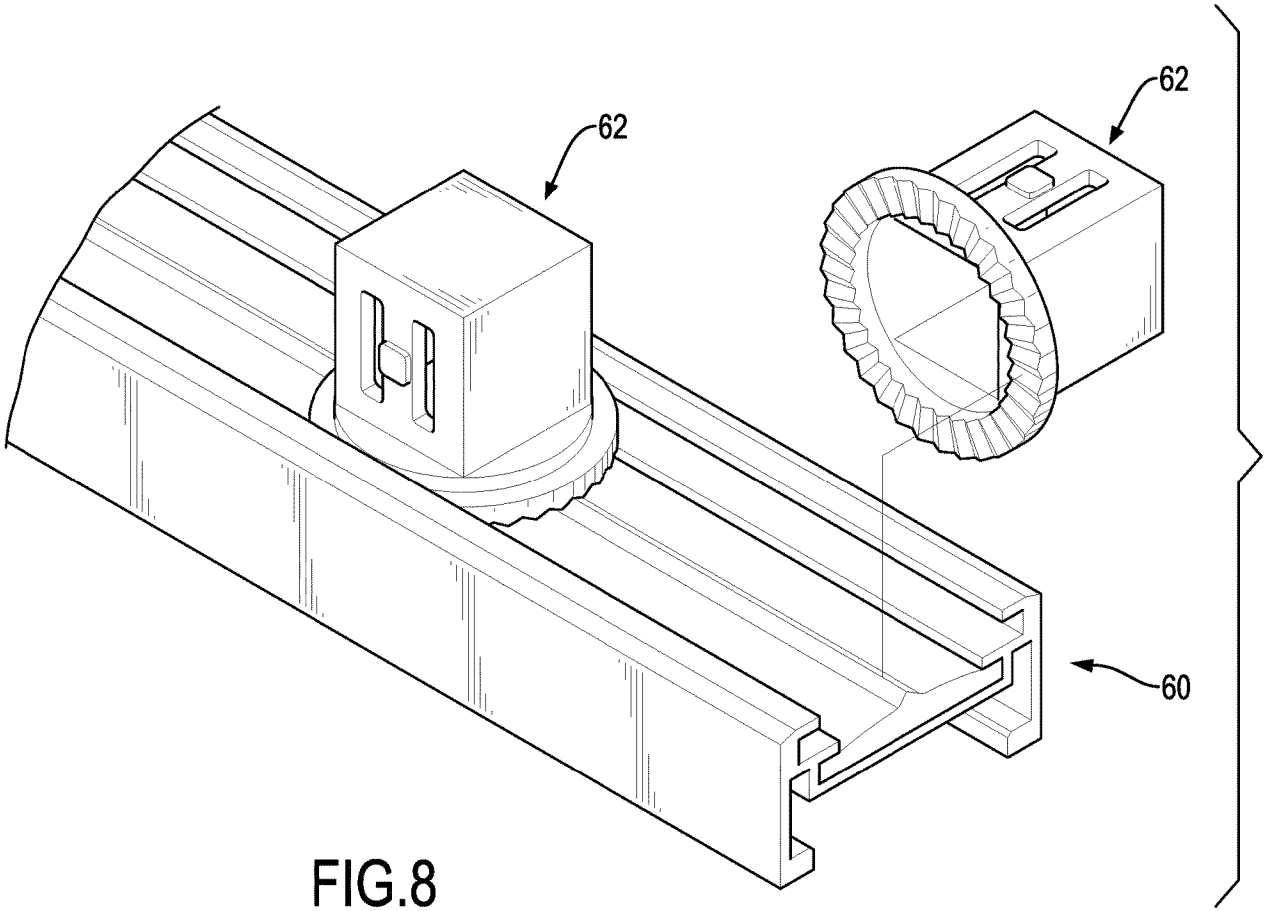
FIG.8 PRIOR ART
FIG. 8 is an exploded perspective view of another conventional socket holding frame.

With reference to FIG. 6, multiple sockets 60 are respectively and detachably mounted around the extending elements 32 of the positioning mounts 30. When each socket 60 is mounted around the extending element 32 of a corresponding positioning mount 30, the protruding ball 321 of the extending element 32 is engaged with a recess in an inner wall of the socket 60. Consequently, the sockets 60 are positioned on the extending elements 32 of the positioning mounts 30.

When numbers or signs on the sockets 60 are not aligned at a same direction to face a user, the user may rotate the sockets 60 in a clockwise or counterclockwise direction relative to the track base 10 to make the numbers or signs of the sockets 60 face the user. During the above-mentioned rotating process, the sliding seats 31 of the positioning mounts 30 may be rotated with the sockets 60 relative to the positioning board 20 by the engagement between the extending elements 32 of the positioning mounts 30 and the sockets 60. When the socket 60 is rotated, the two second engaging segments 312 will be disengaged from the corresponding engaging protrusion 244 due to the resilience of the engaging flange 311 of the positioning mount 30. When the socket 60 is rotated to a desired angle, another adjacent two of the second engaging segments 312 will engage with the engaging protrusion 244. The positioning mount can be positioned in rotation relative to the track base 10 to make the numbers or signs on the sockets 60 face the user.

In addition, to adjust the position of the positioning mount 30 relative to the track base 10, the socket 60 of the positioning mount 30 can be moved along the track base 10 directly. With the resilience of the engaging flange 311 of the positioning mount 30, the engaged parts of the second engaging segments 312 can be disengaged from the corresponding engaging groove 242. When the positioning mount 30 is moved to a desired position, the positioning mount 30 can be positioned in movement relative to the track base 10 by the engagement between said part of the second engaging segments 312 and another engaging groove 242.

To conveniently move or rotate the positioning mount 30, at least one or both of the positioning board 20 and the sliding seats 31 of the positioning mounts 30 is/are resilient. Accordingly, the second engaging segments 312 can be easily engaged with or disengaged from the first engaging segments 24. Thus, to move or to rotate the positioning mount 30 is easy and convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket holding frame comprising:

a track base being an elongated seat and having a bottom panel being elongated and having a top surface;

two rails disposed respectively on two sides of the top surface of the bottom panel, each one of the two rails having a sliding channel having an opening, and the two openings of two sliding channels of the two rails facing each other;

a positioning board disposed on the track base and having two long opposite sides;

a middle, a top surface;

multiple first engaging segments formed on the top surface of the positioning board at spaced intervals and aligned in a straight line, and each first engaging segment comprising a curved engaging groove; and an engaging protrusion formed in the curved engaging groove; and at least one positioning mount slidably and rotatably mounted on the track base, and each one of the at least one positioning mount having a sliding seat slidably and rotatably mounted in the sliding channels of the rails, the sliding seat engaged selectively with one of the multiple first engaging segments on the positioning board and having a bottom side;

a top side; and an engaging flange formed on and protruding downwardly from the bottom side of the sliding seat, and having a bottom surface; and multiple second engaging segments formed on the bottom surface of the engaging flange at spaced intervals and being arranged annularly, wherein parts of the multiple second engaging segments are selectively engaged with one of the multiple first engaging segments; and an extending element formed on and protruding upwardly from the top side of the sliding seat.

2. The socket holding frame as claimed in claim 1, wherein at least one of the positioning board and the at least one positioning mount is resilient.

3. The socket holding frame as claimed in claim 2, wherein the engaging protrusion of each first engaging segment is formed on a middle of the curved engaging groove of the first engaging segment; and the engaging protrusions of the first engaging segments are aligned with each other.

4. The socket holding frame as claimed in claim 3, wherein each rail of the track base further has a positioning channel located below the sliding channel of the rail and having an opening;

the openings of the positioning channels of the two rails face each other;

the positioning board is mounted in the positioning channels in the rails of the track base and further comprises a bottom surface;

two rail bars formed on and protruding outwardly from the bottom surface of the positioning board respectively at the two long opposite sides of the positioning board and mounted respectively in the positioning channels of the rails of the track base; and a recess formed in the bottom surface of the positioning board at the middle of the positioning board, the recess being parallel with the long opposite sides of the positioning board to form a space between the middle of the positioning board and the top surface of the bottom panel.

5. The socket holding frame as claimed in claim 4, wherein the curved engaging groove of each first engaging segment has a depth gradually increasing from two ends to the middle of the curved engaging groove.

6. The socket holding frame as claimed in claim 1, wherein the engaging protrusion of each first engaging segment is formed on a middle of the curved engaging groove of the first engaging segment; and the engaging protrusions of the first engaging segments are aligned with each other.

7. The socket holding frame as claimed in claim 6, wherein each rail of the track base further has a positioning channel located below the sliding channel of the rail and having an opening;

the openings of the positioning channels of the two rails face each other;

the positioning board is mounted in the positioning channels in the rails of the track base and further comprises a bottom surface;

two rail bars formed on and protruding outwardly from the bottom surface of the positioning board respectively at the two long opposite sides of the positioning board and mounted respectively in the positioning channels of the rails of the track base; and a recess formed in the bottom surface of the positioning board at the middle of the positioning board, the recess being parallel with the long opposite sides of the positioning board to form a space between the middle of the positioning board and the top surface of the bottom panel.

8. The socket holding frame as claimed in claim 7, wherein the curved engaging groove of each first engaging segment has a depth gradually increasing from two ends to the middle of the curved engaging groove.

9. The socket holding frame as claimed in claim 1, wherein the curved engaging groove of each first engaging segment has a depth gradually increasing from two ends to the middle of the curved engaging groove.

* * * * *